US005955031A

United States Patent [19]

King, Jr.

[11] Patent Number: 5,955,031

[45] Date of Patent: Sep. 21, 1999

[54] CARBON MONOXIDE SENSOR

[76] Inventor: Joe C. King, Jr., 1015 Biddle St., Knoxville, Tenn. 37914

[21] Appl. No.: 09/001,444

[22] Filed: Dec. 31, 1997

[51] Int. Cl.[6] ..... E05F 15/20

[52] U.S. Cl. ..... 422/98; 422/108; 422/117; 49/31; 49/199; 340/522; 340/528

[58] Field of Search ..... 49/31, 199; 250/222.1; 340/522, 528, 632; 422/105, 108, 117, 83, 98

[56] References Cited

U.S. PATENT DOCUMENTS

| | | | |
|---|---|---|---|
| 4,007,456 | 2/1977 | Paige et al. | 340/507 |
| 4,038,633 | 7/1977 | King | 340/941 |
| 4,197,675 | 4/1980 | Kelly | 49/31 |
| 4,257,319 | 3/1981 | Kucharczyk | 454/256 |
| 4,338,526 | 7/1982 | Martin et al. | 307/116 |
| 4,360,801 | 11/1982 | Duhame | 340/521 |
| 4,819,551 | 4/1989 | Vole | 454/343 |
| 5,508,511 | 4/1996 | Zur et al. | 250/222.1 |
| 5,576,739 | 11/1996 | Murphy | 340/825.06 |
| 5,846,127 | 12/1998 | Kile | 454/195 |

*Primary Examiner*—Jeffrey Snay

[57] ABSTRACT

A carbon monoxide sensing system is provided including a garage having an automatic door adapted to open only upon the receipt of an activation signal. Further provided is a carbon monoxide sensor positioned within the garage and connected to the automatic door for transmitting the activation signal upon the detection of an amount of carbon monoxide which exceeds a predetermined amount. A light beam detector is adapted to generate the activation signal only upon the detection of vehicle within the garage. Also included is a control mechanism connected between the carbon monoxide sensor, light detection and the door opener for allowing the transmission of the activation signal to the door opener only upon the receipt of the activation signal from the light beam detector.

5 Claims, 2 Drawing Sheets

FIG 1
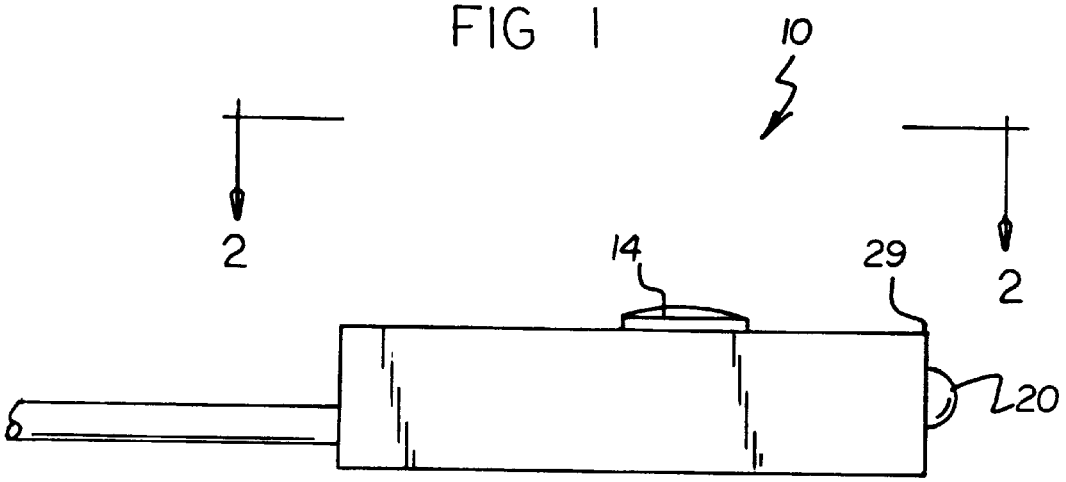
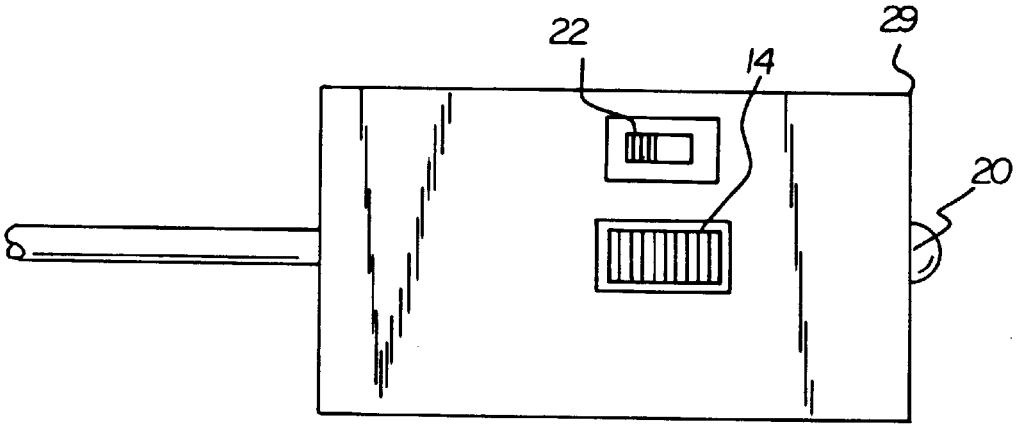
FIG 2

CARBON MONOXIDE SENSOR

BACKGROUND OF THE INVENTION

1. Field of the Invention

The present invention relates to garage door openers and more particularly pertains to a new CARBON MONOXIDE SENSOR for preventing carbon monoxide emitted by a vehicle from causing a fatality.

2. Description of the Prior Art

The use of garage door openers is known in the prior art. More specifically, garage door openers heretofore devised and utilized are known to consist basically of familiar, expected and obvious structural configurations, notwithstanding the myriad of designs encompassed by the crowded prior art which have been developed for the fulfillment of countless objectives and requirements.

Known prior art garage door openers include U.S. Pat. No. 4,819,551; U.S. Pat. No. 4,338,526; U.S. Pat. No. 4,197,675; U.S. Pat. No. 4,257,675; U.S. Pat. No. 4,257,319; and U.S. Pat. No. 4,007,456; and U.S. Pat. No. 4,360,801.

In these respects, the CARBON MONOXIDE SENSOR according to the present invention substantially departs from the conventional concepts and designs of the prior art, and in so doing provides an apparatus primarily developed for the purpose of preventing carbon monoxide emitted by a vehicle from causing a fatality.

SUMMARY OF THE INVENTION

In view of the foregoing disadvantages inherent in the known types of garage door openers now present in the prior art, the present invention provides a new CARBON MONOXIDE SENSOR construction wherein the same can be utilized for preventing carbon monoxide emitted by a vehicle from causing a fatality.

The general purpose of the present invention, which will be described subsequently in greater detail, is to provide a new CARBON MONOXIDE SENSOR apparatus and method which has many of the advantages of the garage door openers mentioned heretofore and many novel features that result in a new CARBON MONOXIDE SENSOR which is not anticipated, rendered obvious, suggested, or even implied by any of the prior art garage door openers, either alone or in any combination thereof.

To attain this, the present invention generally comprises a garage having an automatic door adapted to open only upon the receipt of an activation signal. Further provided is a carbon monoxide sensor positioned within the garage for transmitting the activation signal upon the detection of an amount of carbon monoxide which exceeds a predetermined amount. Also positioned within the garage is a plurality of exhaust fans connected to the carbon monoxide sensor. Each exhaust fan is adapted to expel contaminated air from the garage only when the activation signal is received from the carbon monoxide sensor. For detecting the presence of a vehicle within the garage, a light beam transmitter is situated on a first side wall of the garage. In use, the light beam transmitter adapted for continuously transmitting a beam of light toward a second side wall of the garage. Associated therewith is a light beam receiver situated on the second side wall of the garage directly across from the light beam transmitter. The light beam receiver is adapted to transmit the activation signal only upon the lack of receipt of the light beam as in the case where a vehicle is present. As shown in FIG. 3, a switch is included having a first contact connected to a voltage source adapted to continuously transmit the activation signal A second contact of the switch is connected to the light beam receiver. The switch further has a third contact connected with the first contact in a first orientation and connected with the second contact in a second orientation. In use, the switch may be manually transferred between the first and second orientation thereof. With reference still to FIG. 3, an AND gate is shown having a first input connected to the carbon monoxide sensor and a second input connected to the third contact of the switch. An output of the AND gate is connected to the automatic door of the garage.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new CARBON MONOXIDE SENSOR apparatus and method which has many of the advantages of the garage door openers mentioned heretofore and many novel features that result in a new CARBON MONOXIDE SENSOR which is not anticipated, rendered obvious, suggested, or even implied by any of the prior art garage door openers, either alone or in any combination thereof.

It is another object of the present invention to provide a new CARBON MONOXIDE SENSOR which may be easily and efficiently manufactured and marketed.

It is a further object of the present invention to provide a new CARBON MONOXIDE SENSOR which is of a durable and reliable construction.

An even further object of the present invention is to provide a new CARBON MONOXIDE SENSOR which is susceptible of a low cost of manufacture with regard to both materials and labor, and which accordingly is then susceptible of low prices of sale to the consuming public, thereby making such CARBON MONOXIDE SENSOR economically available to the buying public.

Still yet another object of the present invention is to provide a new CARBON MONOXIDE SENSOR which provides in the apparatuses and methods of the prior art some of the advantages thereof, while simultaneously overcoming some of the disadvantages normally associated therewith.

Still another object of the present invention is to provide a new CARBON MONOXIDE SENSOR for preventing carbon monoxide emitted by a vehicle from causing a fatality.

Even still another object of the present invention is to provide a new CARBON MONOXIDE SENSOR that includes a garage having an automatic door adapted to open only upon the receipt of an activation signal. Further provided is a carbon monoxide sensor positioned within the garage and connected to the automatic door for transmitting the activation signal upon the detection of an amount of carbon monoxide which exceeds a predetermined amount. A light beam detector is adapted to generate the activation signal only upon the detection of vehicle within the garage. Also included is a control mechanism connected between the carbon monoxide sensor, light detection and the door opener for allowing the transmission of the activation signal to the door opener only upon the receipt of the activation signal from the light beam detector.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new CARBON MONOXIDE SENSOR according to the present invention.

FIG. 2 is a top view of the present invention.

DESCRIPTION OF THE PREFERRED EMBODIMENT

Figure 3:
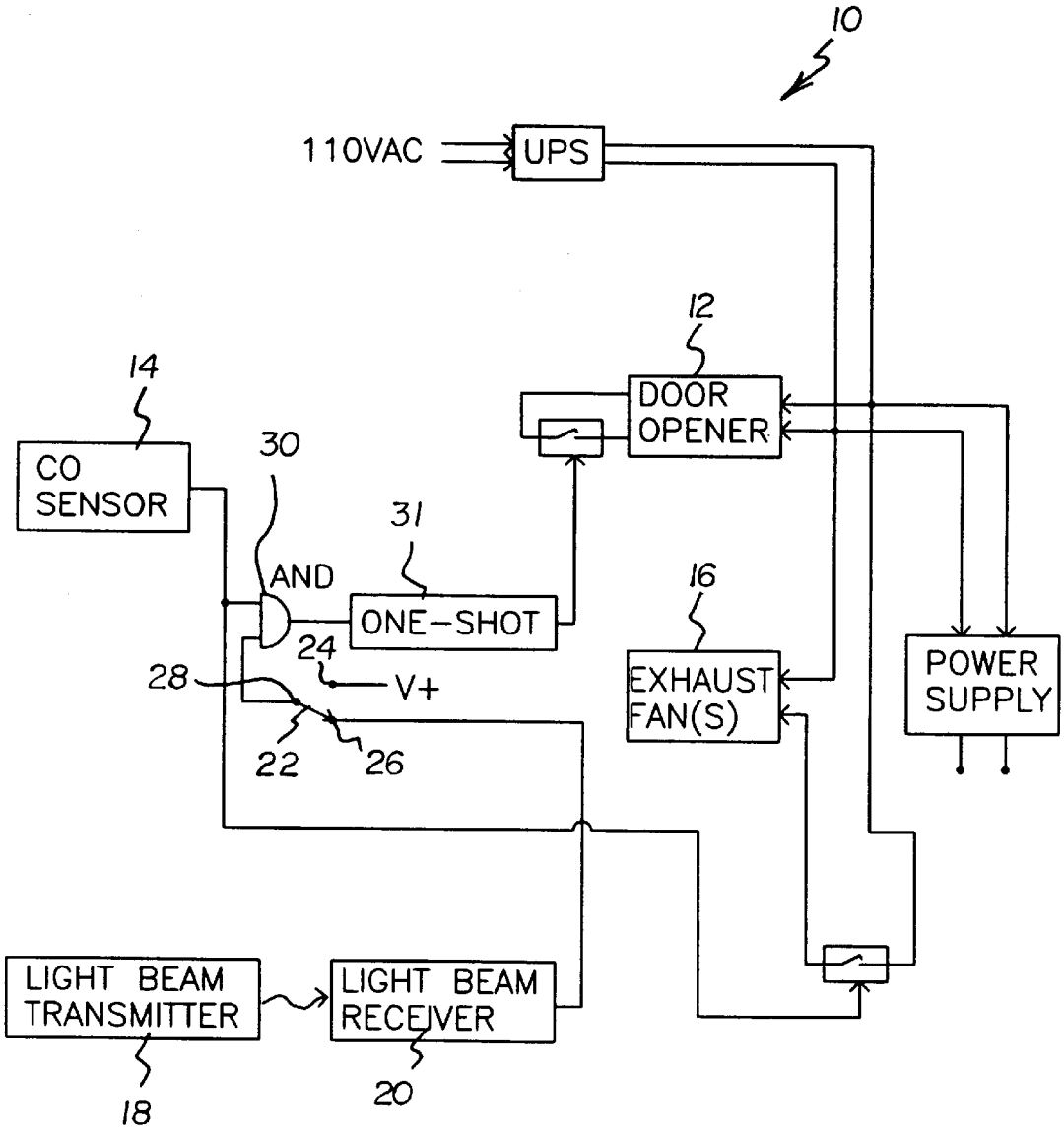
FIG. 3 is a schematic diagram of the various electrical components of the present invention.

With reference now to the drawings, a new CARBON MONOXIDE SENSOR embodying the principles and concepts of the present invention and generally designated by the reference numeral 10 will be described.

The system 10 of the present invention includes garage having an automatic door 12 adapted to open only upon the receipt of an activation signal.

Further provided is a carbon monoxide sensor 14 positioned within the garage for transmitting the activation signal upon the detection of an amount of carbon monoxide which exceeds a predetermined amount.

Also positioned within the garage is a plurality of exhaust fans 16 connected to the carbon monoxide sensor. Each exhaust fan is adapted to expel contaminated air from the garage only when the activation signal is received from the carbon monoxide sensor. In the present description, it should be noted that the activation signal comprises a voltage pulse. As shown in FIG. 3, the automatic door of the garage and the exhaust fans are actuated by way of a voltage controlled switch to ensure that a proper voltage is supplied thereto.

For detecting the presence of a vehicle within the garage, a light beam transmitter 18 is situated on a first side wall of the garage. In use, the light beam transmitter adapted for continuously transmitting a beam of light toward a second side wall of the garage. Associated therewith is a light beam receiver 20 situated on the second side wall of the garage directly across from the light beam transmitter. The light beam receiver is adapted to transmit the activation signal only upon the lack of receipt of the light beam as in the case where a vehicle is present. It should be noted that in another embodiment, the transmitter and receiver are situated adjacent each other and utilize a reflector to transmit a light beam therebetween.

As shown in FIG. 3, a switch 22 is included having a first contact 24 connected to a voltage source adapted to continuously transmit the activation signal A second contact 26 of the switch is connected to the light beam receiver. The switch further has a third contact 28 connected with the first contact in a first orientation and connected with the second contact in a second orientation. In use, the switch may be manually transferred between the first and second orientation thereof. In the preferred embodiment, the switch and the remaining components with the exception of the light source are situated on and within a housing 29. Note FIGS. 1 & 2.

With reference still to FIG. 3, an AND gate 30 is shown having a first input connected to the carbon monoxide sensor and a second input connected to the third contact of the switch. An output of the AND gate is connected to the automatic door of the garage. Connected between the AND gate and the automatic door is a one shot multivibrator 31 adapted to transmit the activation signal for a predetermined amount of time corresponding to that which it takes to open the door.

In use, the exhaust fans expel contaminated air unconditionally upon the detection of carbon monoxide by the carbon monoxide sensor. In a first mode of operation, the automatic door opens unconditionally upon the detection of carbon monoxide by the carbon monoxide sensor. In a second mode of operation, the automatic door of the garage opens only when the vehicle is present and the carbon monoxide sensor has detected carbon. The second mode of operation thus prevents the opening of the door when the vehicle is not present.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carbon monoxide sensing system comprising, in combination:

a garage having an automatic door adapted to open only upon the receipt of an activation signal;

a carbon monoxide sensor positioned within the garage for transmitting the activation signal upon the detection of an amount of carbon monoxide which exceeds a predetermined amount;

a plurality of exhaust fans positioned within the garage and connected to the carbon monoxide sensor, each exhaust fan adapted to expel contaminated air from the garage only when the activation signal is received from the carbon monoxide sensor;

a light beam transmitter situated on a first side wall of the garage for continuously transmitting a beam of light toward a second side wall of the garage;

a light beam receiver situated on the second side wall of the garage directly across from the light beam transmitter, the light beam receiver adapted to transmit the activation signal only upon the lack of receipt of the light beam as in the case where a vehicle is present;

a switch having a first contact connected to a voltage source adapted to continuously transmit the activation signal, a second contact connected to the light beam receiver, and a third contact connected with the first contact in a first orientation and connected with the second contact in a second orientation, whereby the switch may be manually transferred between the first and second orientation thereof; and an AND gate having a first input connected to the carbon monoxide sensor, a second input connected to the third contact of the switch, and an output connected to the automatic door of the garage;

whereby the exhaust fans expel contaminated air unconditionally upon the detection of carbon monoxide by the carbon monoxide sensor and the automatic door opens unconditionally upon the detection of carbon monoxide by the carbon monoxide sensor in a first mode of operation and further opens only when the vehicle is present and the carbon monoxide sensor has detected carbon monoxide in a second mode of operation.

2. A carbon monoxide sensing system comprising:

a garage having an automatic door adapted to open only upon the receipt of an activation signal;

a carbon monoxide sensor positioned within the garage and connected to the automatic door for transmitting the activation signal thereto upon the detection of an amount of carbon monoxide which exceeds a predetermined amount;

a light beam detection means adapted to transmit the activation signal only upon the detection of vehicle within the garage; and control means connected between the carbon monoxide sensor, the light detection means and the door opener for allowing the transmission of the activation signal to the door opener only upon the receipt of the activation signal from the light beam detection means.

3. A carbon monoxide sensing system as set forth in claim 2 wherein at least one exhaust fan is positioned within the garage and connected to the carbon monoxide sensor, each exhaust fan adapted to expel contaminated air from the garage only when the activation signal is received from the carbon monoxide sensor.

4. A carbon monoxide sensing system as set forth in claim 2 wherein the light beam detection means comprises a light beam transmitter situated on a first side wall of the garage for continuously transmitting a beam of light toward a second side wall of the garage and a light beam receiver situated on the second side wall of the garage directly across from the light beam transmitter, the light beam receiver adapted to transmit the activation signal only upon the lack of receipt of the light beam as in the case where a vehicle is present.

5. A carbon monoxide sensing system as set forth in claim 2 wherein the control means includes a switch having a first contact connected to a voltage source adapted to continuously transmit the activation signal, a second contact connected to the light beam detection means, and a third contact connected with the first contact in a first orientation and connected with the second contact in a second orientation, whereby the switch may be manually transferred between the first and second orientation thereof, the control means further including an AND gate having a first input connected to the carbon monoxide sensor, a second input connected to the third contact of the switch, and an output connected to the automatic door of the garage.

* * * * *